US006192777B1

(12) United States Patent
Williams et al.

(10) Patent No.: US 6,192,777 B1
(45) Date of Patent: Feb. 27, 2001

(54) METHOD AND APPARATUS FOR PATTERN MATCHING WITH ACTIVE VISUAL FEEDBACK

(75) Inventors: Kevin M. Williams, Cromwell; Jeffrey S. Monroe, Bolton, both of CT (US)

(73) Assignee: Gerber Garment Technology, Inc., Tolland, CT (US)

( * ) Notice: Subject to any disclaimer, the term of this patent is extended or adjusted under 35 U.S.C. 154(b) by 0 days.

(21) Appl. No.: 09/062,495

(22) Filed: Apr. 17, 1998

(51) Int. Cl.[7] ..... B26D 3/00

(52) U.S. Cl. ..... 83/56; 83/76.6; 83/75; 83/75.5

(58) Field of Search ..... 83/168, 940, 941, 83/938, 664, 665, 100, 22, 76.6, 169, 175, 431, 48, 49, 56, 76.7, 76.8, 75, 75.5, 72, 56.5, 360, 368, 365, 370, 372

(56) References Cited

U.S. PATENT DOCUMENTS

| | | | |
|---|---|---|---|
| 3,529,298 | 9/1970 | Lourie . | |
| 3,596,068 | 7/1971 | Doyle . | |
| 4,176,566 | 12/1979 | Patterson et al. . | |
| 4,435,837 | 3/1984 | Abernathy . | |
| 4,452,113 * | 6/1984 | Pearl | 83/56 |
| 4,583,181 | 4/1986 | Gerber et al. . | |
| 4,739,487 | 4/1988 | Bonnet et al. . | |
| 4,744,035 | 5/1988 | Hashim . | |
| 4,758,960 | 7/1988 | Jung . | |
| 4,941,183 | 7/1990 | Bruder et al. . | |
| 4,982,437 | 1/1991 | Loriot . | |
| 5,258,917 | 11/1993 | Bruder et al. . | |
| 5,381,258 | 1/1995 | Bordignon et al. . | |
| 5,508,936 | 4/1996 | King et al. . | |
| 5,836,224 * | 11/1998 | Gerber | 83/22 |
| 5,975,743 | 11/1999 | Bercaits . | |

FOREIGN PATENT DOCUMENTS

| | | |
|---|---|---|
| 07 62251 | 3/1997 | (EP) . |
| 2548077 | 1/1985 | (FR) . |
| 2548708 | 11/1985 | (FR) . |
| 2731595 | 9/1996 | (FR) . |
| 2196213 | 4/1988 | (GB) . |

OTHER PUBLICATIONS

Copy of European Search Report Jun. 15, 2000.

* cited by examiner

*Primary Examiner*—Lee Young
*Assistant Examiner*—Sean Smith
(74) *Attorney, Agent, or Firm*—McCormick, Paulding & Huber LLP

(57) ABSTRACT

An apparatus and method for cutting pieces of material from a workpiece, such as a web of patterned fabric, which includes irregularities or which is misaligned with respect to a coordinate system of the cutting apparatus. The workpiece is spread on a cutting table where it is cut by a numerically controlled cutter in accord with an electronic marker stored in the cutter controller. The marker is matched to the workpiece and appropriate adjustments are made to the marker before the workpiece is cut. A laser, operatively connected to the controller, projects a match target onto the workpiece at a point corresponding to a selected point on the marker. The marker is then adjusted such that the selected point coincides with a desired location on the workpiece. Adjustment is achieved by electronically displacing the match target from a non preferred location to a preferred one. Software in the controller translates this displacement into appropriate adjustments to the marker. The displacement is effected with an electromagnetic pointing device which coacts with a digitizing grid embedded in the cutting table work surface and operatively connected to the controller.

11 Claims, 3 Drawing Sheets

METHOD AND APPARATUS FOR PATTERN MATCHING WITH ACTIVE VISUAL FEEDBACK

FIELD OF THE INVENTION

The present invention pertains to fabric cutting apparatus and methods and, more particularly to an improved apparatus and method for cutting pieces of material from a workpiece, such as a web of patterned fabric, which includes irregularities or which is misaligned with respect to a coordinate system of the cutting apparatus.

BACKGROUND

Automated fabric cutting systems, wherein numerically controlled cutters cut pieces of material from a workpiece, are widely used. So long as the fabric is consistent and free of imperfections, such cutting systems can produce accurately cut pieces. Unfortunately, textile irregularities and flaws are common in most fabrics and pose a particular challenge to upholstery and apparel manufacturing, where matching of patterns is critical. Further, when a patterned fabric is spread on the work surface of a cutting table, the lines of the pattern are often bowed or skewed with respect to the table axes. While it may be possible to correct such placement or orientation problems manually, such corrections are extremely time-consuming.

It is known to compensate for these conditions by adjusting the electronic markers which direct the cutting operation. Such adjustments, however, require the establishment of a correlation or matching between points on the marker and the corresponding points on the workpiece. Efforts have been made to display this correlation by optically projecting the marker onto the workpiece. Unfortunately, visibility of the optically projected marker requires that the work area be suitably darkened. This is often impossible or unacceptable. Further problems arise where such systems are used in conjunction with very large workpieces. In such cases, the projected light beams spread, especially near the workpiece edges, to the extent that acceptable accuracy may not be attained. In addition, such light projection systems, for use with large workpieces, are complex and costly.

A shortcoming associated with conventional computerized display systems is the lack of a clear, well defined correlation between the marker (displayed on a monitor) and the workpiece. If an irregularity is noted on the workpiece, it is not readily apparent where the corresponding point lies on the marker displayed on a monitor. This shortcoming is magnified by the lack of a convenient and ergonomically sound means of making changes to the marker. Most commonly, changes are entered through a computer keyboard. Entry of changes by this means requires that the operator repeatedly shift attention from the workpiece to the marker display device. Such repeated shifting of attention often causes the operator to lose track of the specific area, requiring adjustment in a sea of similarly patterned areas. Further, such systems may simultaneously present so much information as to compound this problem.

It is, therefore, an object of the present invention to provide an apparatus and method for optimizing the cutting of pieces of material from a workpiece such as a patterned fabric.

It is a further object to provide an apparatus and method for accurately and efficiently adjusting an electronic marker to compensate for irregularities or misalignments in a workpiece.

It is another object to provide an apparatus as aforesaid which may be readily integrated with existing automated fabric cutting systems, at minimal cost.

SUMMARY OF THE INVENTION

The present invention is directed to an improved apparatus and method for cutting pieces of material from a workpiece such as a sheet of patterned fabric. The workpiece is spread on a cutting table where it is cut by a numerically controlled cutter in accord with an electronic marker stored in the cutter controller. The marker is matched to the workpiece and appropriate adjustments are made to the marker before the workpiece is cut. A laser, operatively connected to the controller, projects a match target onto the workpiece at a point corresponding to a selected point on the marker. The marker is then adjusted such that the selected point coincides with a desired location on the workpiece. Adjustment is achieved by electronically displacing the match target from a non preferred location to a preferred one. Software in the controller translates this displacement into appropriate adjustments to the marker. The displacement is effected with an electromagnetic pointing device which coacts with a digitizing grid embedded in the cutting table work surface and operatively connected to the controller.

DESCRIPTION OF THE PREFERRED EMBODIMENTS

In the following description, an illustrative embodiment of the present invention is described in connection with the use of apparatus shown and described in U.S. Pat. No. 3,495,492 entitled "Apparatus For Working On Sheet Material" and U.S. Pat. No. 3,548,697 entitled "Apparatus For Cutting Sheet Material", which are assigned to the assignee of the present invention. It will be appreciated that the invention is not limited solely to use with such apparatus.

Figure 1:
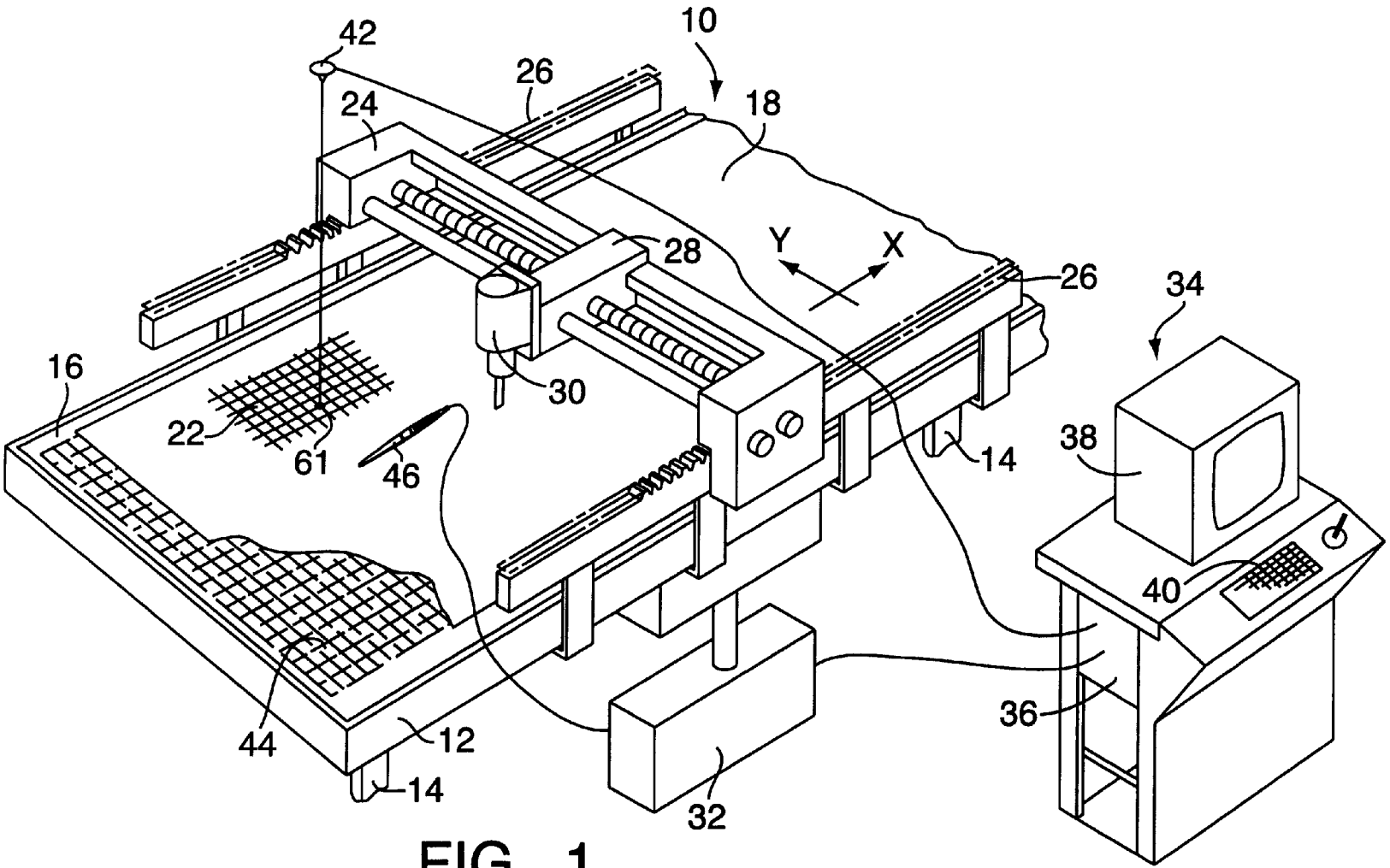
FIG. 1 is a simplified schematic illustration of an apparatus in accord with the present invention.

Referring now to FIG. 1, a fabric cutting apparatus, which is referred to generally with the reference character 10, is shown having a cutting table 12 supported on legs 14. The cutting table 12 includes a flat upper work surface 16 adapted to support a workpiece 18, a sheet of material or fabric having a periodic geometric design 22 woven therein, in position to be cut.

A main carriage 24, which transversely spans the table 12, is supported on the table by a pair of elongated racks 26 mounted on opposite sides of the cutting table 12 and extending longitudinally thereof for moving the carriage 24 in a first coordinate direction indicated by the arrow "X". The main carriage 24 movably carries thereon a cutter carriage 28 mounted for movement in a second coordinate direction indicated by the arrow "Y".

The cutter carriage 28 has a cutter head 30 mounted thereon. Those skilled in the art will recognize that various cutting devices, including rotating blades, reciprocating blades, and lasers or water jets may be employed in the cutter head 30 without departing from the broader aspects of the present invention.

The cutting apparatus 10 includes an embedded controller 32, in communication with the cutting apparatus 10 and with a user interface generally designated 34. The user interface 34 can assume many different forms and in the illustrated embodiment incudes a computer processor 36 in operable communication with a video display 38, and a keyboard 40.

The cutting apparatus 10 is primarily used to cut pattern pieces from sheets of fabric in accordance with what is referred to by those skilled in the pertinent art as a marker. A marker is comprised of a representation of a fabric sheet having plurality of adjacent pattern pieces arranged as closely as possible to one another on the sheet so as to minimize the waste when the pattern pieces are cut from a piece of fabric. The present apparatus is adapted to use a marker comprising a computer generated data file resident in the computer processor 36.

When cutting pattern pieces from a plaid or other fabric having a repeating design or pattern care must be exercised when positioning the pattern on the sheet of fabric to insure that the garment pieces will have the desired alignment when sewn together. Consequently, the marker includes not only information regarding the perimeter of the garment pieces but also contains data on the fabric pattern and the desired relationship of the particular garment pieces. This correlating information is in the form of "matching" or reference points typically located in the interior of the piece templates where a particular point in the fabric pattern is supposed to lie. In the present context, "matching" is defined as the alignment of fabric pattern repeats in the fabric from one piece of a garment to a corresponding piece, i.e., the top sleeve of a man's coat matching the front part thereof at a specified point. Moreover, it is sometimes necessary to align the marker or a portion thereof with the web of the fabric because the web has been placed on the cutting table at a slight angle or because of inaccuracies in the fabric. The present apparatus and method have the capability of accomplishing this alignment, as detailed herein.

In order to provide for a matching between a point on the marker and the corresponding location on the workpiece, a laser projector 42 is pivotably supported above the cutting table 12 so as to permit projection of a match target 61 onto any point on a workpiece spread on the work surface 16. The laser projector 42 is operatively connected to the computer processor 36 and is directed and controlled by instructions received therefrom.

As shown in FIG. 1, a digitizing grid 44 is embedded in the cutting table work surface 16 and may comprise multiple, connected digitizing bed sections (not separately shown) as are more fully described in U.S. Pat. No. 5,684,692 and assigned to the assignee of the present invention. The digitizing grid 44 is connected to the embedded controller 32. An electromagnetic pointing device 46 is cooperatively associated with the digitizing grid 44 in a known way such that, as the tip of the pointing device 46 is waved or passed over the grid 44, the grid provides signals to the embedded controller 32 that define the position of pointing device relative to the grid in X and Y coordination.

Figure 2A:
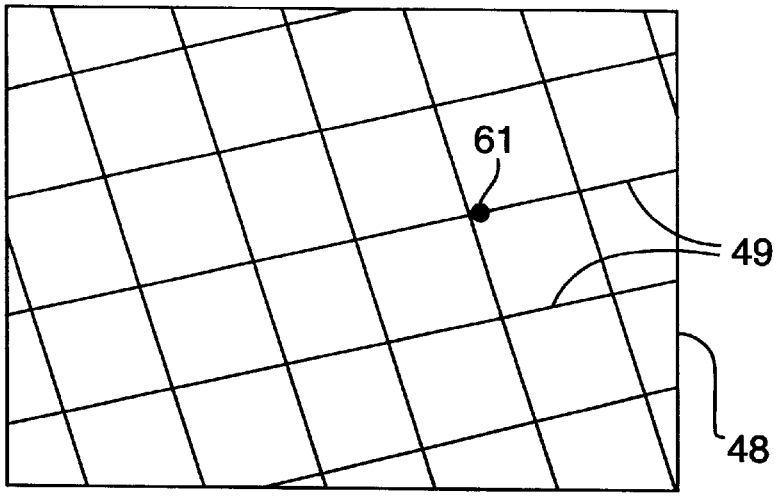
FIG. 2A is a simplified schematic illustration of a portion of a misaligned workpiece on a cutting table of the apparatus of FIG. 1.

Referring now to FIG. 2A, there is shown a simplified schematic illustration of a portion of a misaligned workpiece 48 spread on the cutting table 12 of the present apparatus. In this example, the misalignment includes both skewing and bowing of the fabric pattern as evidenced by the lines 49 corresponding to the plaid pattern. The extent of this misalignment is exaggerated for illustrative purposes.

Figure 2B:
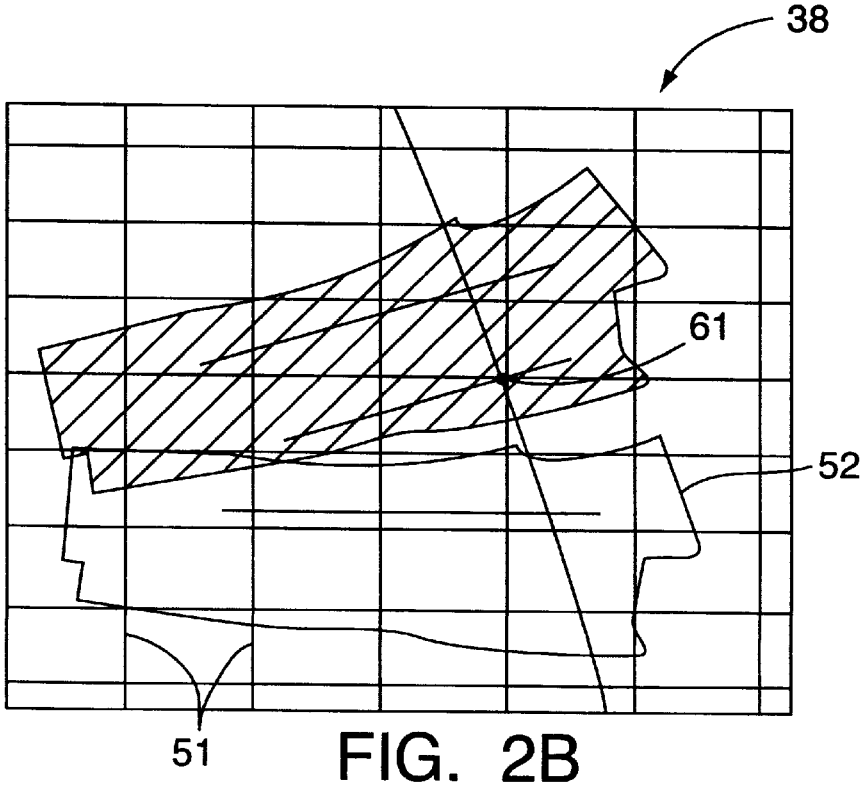
FIG. 2B is a simplified schematic, illustrating rotation of a pattern piece from the ideal plaid and stripe lines in a marker to the actual plaid and stripe lines of the workpiece illustrated in FIG. 2A.

With the workpiece 48 spread on the cutting table work surface 16, the marker is displayed on the video display 38, as shown in FIG. 2B. It should be appreciated that the marker is a mathematical model constructed on the implicit assumption that the patterned workpiece is free of imperfections, regular and properly aligned with respect to the coordinate system of the work surface 16 as illustrated by the lines 51 and the pattern piece 52. To the extent that the workpiece departs from this ideal, the marker must be adjusted or modified to compensate for irregularities in the workpiece or misalignment on the work surface.

The adjustment process is begun by establishing a correlation or matching of points between the marker and the workpiece. Piece to piece matching of parts lying adjacent to each other on the workpiece is also established. A point is selected on the marker and the expected position of the corresponding point on the workpiece is identified by projecting a match target 48 thereon from the laser projector 42. The match target 48 may be a simple dot, a cross-hair or other position indicating device. The point selected may advantageously be one of two "matching" points located in the interior of the piece templates or may be a point on the edge of a piece, preferably on a corner. The marker is then adjusted such that the selected point thereon coincides with a desired location on the workpiece. This process is repeated as necessary to compensate for all observed irregularities. When adjustment of the marker is complete, the adjusted marker is utilized to direct the cutting device to cut the pieces of material from the workpiece.

Adjustment of the marker, once a correspondence has been established between a point shown on the video display 38 and a point on the workpiece 18, is accomplished by electronically displacing the match target from its original, non preferred position to a preferred position. Software, embedded in the marker-generating program automatically translates this displacement into the corresponding adjustment to the marker. Such embedded software is commonly included in marker-generating programs.

Displacement of the match target 48 is achieved using the electromagnetic pointing device 46 and digitizing grid 44. The pointing device 46 is placed on the work surface 16, at any convenient location, and moved so as to "pull" or "drag" the match target 48 to the preferred location. This is accomplished in much the same manner as using a mouse attached to a computer, and moved on a mouse pad. It will be appreciated that there is no need for the user to actually touch the pointing device 46 to the light spot 48, which may be beyond convenient reach.

Figure 3:
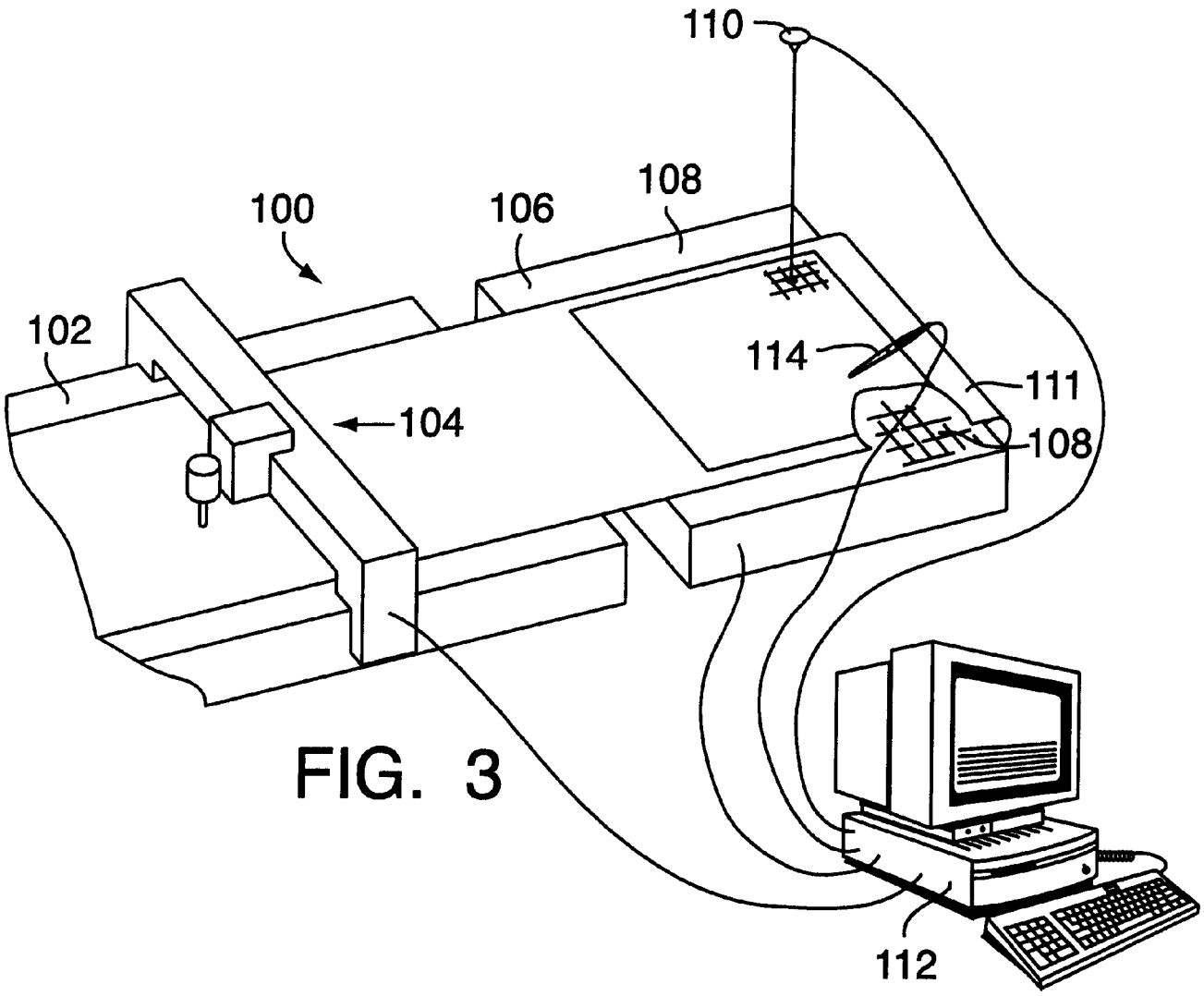
FIG. 3 is a simplified schematic illustration of a second apparatus in accord with the present invention.

In order to maximize the use of the cutting table 12 for cutting operations, it may be desirable to provide a separate spreading table, where the marker is "matched" or adjusted and then transferred to the cutting table, preferably by a motorized conveyor. This allows one workpiece to be matched while simultaneously a previously matched workpiece is being cut on the cutting table. Turning to FIG. 3, such an apparatus, which is referred to generally with the reference character 100 is shown having a cutting table 102 with a numerically controlled cutting system 104 as herein above described. A spreading table 106, having a flat upper work surface 108, is located adjacent to the cutting table 102 and is connected thereto by a motorized conveyor 111 adapted to transfer a workpiece from the spreading table 106 to the cutting table 102.

While the apparatus has been shown and described as employing a single spreading table 106 and cutting table 102, the present invention is not limited in this regard. For example, a plurality of spreading tables can be provided and positioned in a side-by-side relationship adjacent to one another. The cutting table can move from one spreading table to another by means of a transverse drive mechanism. During movement, the cutting table can continue its cutting operations.

Embedded in the spreading table work surface 106 is a digitizing grid 108. A laser light projector 110 is pivotably supported above the spreading table 106 so as to permit projection of a match target on any point on a workpiece spread on the work surface 106. The laser projector 110 is operatively connected to a computer processor 112 which is also connected to an electromagnetic pointing device, such as a pen, stylus or cursor 1 14 cooperatively associated with the digitizing grid 108. The computer processor 112 is further operatively connected to the numerically controlled cutting system 102.

It will be appreciated that an apparatus in accordance with the present invention requires the addition of few new components to existing automated fabric cutting systems and that those few components, notably the electromagnetic pointing device, the digitizing grid, and the laser and its mounting, are relatively inexpensive as compared to light projection devices for projecting an entire marker on a workpiece. Unlike existing marker-modification systems, which utilize conventional light beams, the present system does not require darkening of the work area. Likewise, the use of a laser beam causes the projected match target to remain tightly focused, such that there is no loss of accuracy resulting from beam spread. Further, the system allows attention to be directed to a single clearly-indicated point on the workpiece.

It will also be appreciated that the method of adjustment of the marker, by utilizing the electromagnetic pointing device and digitizing grid to displace the match target, is "natural" to most users and, often, is already familiar to them. Such adjustment does not require diversion of attention from the workpiece point being addressed. Further, even though the digitizing grid encompasses the entire cutting table work surface, physical access to remote areas of the table is not necessary. The operator need not be able to reach the point on the workpiece where an adjustment is being made, as relative movement of the electromagnetic pointing device will translate to absolute position of the match target on the workpiece.

As will be recognized by those skilled in the pertinent art, numerous changes and modifications may be made to the above-described and other embodiments of the present invention without departing from its scope as defined in the appended claims. Accordingly, the detailed description of the preferred embodiments herein is to be taken in an illustrative as opposed to a limiting sense.

What is claimed is:

1. An apparatus for cutting pieces of material from a workpiece such as a web of patterned fabric, said apparatus comprising:

a cutting table defining a work surface;

a numerically controlled cutting device for cutting a workpiece on said work surface;

a controller operatively connected to said cutting device;

an electronic marker stored in said controller, for directing the operation of said apparatus;

light projecting means for projecting a match target on a point of the workpiece which corresponds to a designated point on said electronic marker; and input means, operatively connected to said cutting table, for entering adjustments to said electronic marker.

2. The apparatus of claim 1, wherein said input means includes:

means for electronically displacing a match target projected on the workpiece from a non preferred position to a preferred position; and means for translating said displacement into appropriate adjustments to said marker.

3. The apparatus of claim 1, wherein said input means includes a digitizing grid embedded in said cutting table and an electromagnetic pointing device operatively connected to said digitizing grid.

4. The apparatus of claim 1, wherein said light projecting means includes a laser operatively connected to said controller.

5. An apparatus for cutting pieces of material from a workpiece such as a web of patterned fabric, comprising:

a spreading table defining a work surface adapted to be coupled to a numerically controlled cutting device for cutting a workpiece;

a controller operatively connected to said cutting device;

an electronic marker stored in said controller, for directing the operation of said cutting device;

light projecting means for projecting a match target on a point of a workpiece, supported on said work surface, which corresponds to a designated point on said electronic marker; and input means, operatively connected to said spreading table, for entering adjustments to said electronic marker.

6. The apparatus of claim 5, wherein said input means includes a digitizing grid embedded in said spreading table and an electromagnetic pointing device operatively connected to said digitizing grid.

7. The apparatus of claim 5, wherein said light projecting means includes a laser operatively connected to said controller.

8. A method for cutting pieces of material from a workpiece such as a web of patterned fabric, said method comprising the steps of:

providing an automated cutting system including a cutting table, a numerically controlled cutting device for cutting a workpiece spread on said cutting table, a controller operatively connected to said cutting device, and an electronic marker stored in said controller for directing the operation of said cutting device;

spreading the workpiece on said cutting table;

selecting a point on said electronic marker;

projecting a match target on the workpiece at a location corresponding to the selected point;

adjusting said marker such that the selected point thereon coincides with a desired location on the workpiece; and utilizing the adjusted electronic marker to direct said cutting device to cut pieces of material from the workpiece.

9. The method of claim 8, wherein adjustment of said electronic marker includes the steps of:

electronically displacing a match target projected on the workpiece from a non preferred position to a preferred position; and translating the displacement of the match target into appropriate adjustments to said electronic marker.

10. A method for cutting pieces of material from a workpiece such as a web of patterned fabric, said method comprising the steps of:

providing an automated cutting system including a spreading table, a cutting table, a numerically controlled cutting device for cutting a workpiece spread on said cutting table, a controller operatively connected to said cutting device, and an electronic marker stored in said controller for directing the operation of said cutting device;

spreading the workpiece on said spreading table;

selecting a point of said electronic marker;

projecting a match target on the workpiece at a location corresponding to the selected point;

adjusting said electronic marker such that the selected point thereon coincides with a desired location on the workpiece;

transferring the workpiece to said cutting table;

utilizing the adjusted electronic marker to direct said cutting device to cut pieces of material from the workpiece.

11. The method of claim 10, wherein adjustment of said electronic marker includes the steps of:

electronically displacing a match target projected on the workpiece from a non preferred position to a preferred position; and translating the displacement of the match target into appropriate adjustments to said electronic marker.

* * * * *